US006546739B2

(12) United States Patent
Frimm et al.

(10) Patent No.: US 6,546,739 B2
(45) Date of Patent: Apr. 15, 2003

(54) METHOD AND APPARATUS FOR OFFSHORE LNG REGASIFICATION

(75) Inventors: Fernando C. Frimm, Houston, TX (US); Johan Robert Karel De Laender, Watervliet (BE); Leo Florent Lucien Cappoen, Zellik (BE)

(73) Assignee: Exmar Offshore Company, Houston, TX (US)

( * ) Notice: Subject to any disclaimer, the term of this patent is extended or adjusted under 35 U.S.C. 154(b) by 0 days.

(21) Appl. No.: 09/863,696

(22) Filed: May 23, 2001

(65) Prior Publication Data

US 2002/0174662 A1 Nov. 28, 2002

(51) Int. Cl.[7] ..... F17C 9/02
(52) U.S. Cl. ..... 62/50.2; 62/240
(58) Field of Search ..... 62/50.3, 50.2, 62/240, 53.1

(56) References Cited

U.S. PATENT DOCUMENTS

| | | | | |
|---|---|---|---|---|
| 2,940,268 A | * | 6/1960 | Morrison | 62/50.2 |
| 3,018,632 A | * | 1/1962 | Keith | 62/50.2 |
| 3,161,492 A | * | 12/1964 | Keith et al. | 62/911 |
| 3,766,583 A | | 10/1973 | Phelps | 9/8 P |
| 3,950,805 A | | 4/1976 | Murphy | 9/8 |
| 6,089,022 A | | 7/2000 | Zednik et al. | 60/641.7 |
| 6,176,191 B1 | | 1/2001 | Fernandes et al. | 114/142 |
| 6,298,671 B1 | * | 10/2001 | Kennelley et al. | 62/53.1 |

FOREIGN PATENT DOCUMENTS

| | | | |
|---|---|---|---|
| DE | 29 28 272 A1 | 1/1981 | B63B/9/04 |
| GB | 234 5716 A | 7/2000 | E02B/17/02 |

OTHER PUBLICATIONS

T.G. Karlsen, "Floating LNG Storage and Regasification Unit",American Institute of Chemical Engineers Conference, Houston, Texas, Apr. 24, 2001, 2 pages.

Tecnomare.it website; article entitled: "LNG Floating Terminal", printed May 15, 2001. 3 pages.

Gary W. Van Tassel; John W. Boylston; "An Economic System for the Liquefaction, Transport and Regas of Natural Gas Using Surplas LNG Carriers", The Society of Naval Architects and Marine Engineers, Marine Symposium, New York, Sep. 1984, pp. 17–1–17–7.

"Ocean Industry –U.S. Report" –article "Single Point Mooring System for Floating LNG Plant" dated Nov. 1978; 2 pages.

PCT International Search Report dated Oct. 08, 2002.

* cited by examiner

*Primary Examiner*—Ronald Capossela
(74) *Attorney, Agent, or Firm*—Rosenthal & Osha L.L.P.

(57) ABSTRACT

An offshore liquefied natural gas regasification system is disclosed, which includes a mobile floating platform having a regasification unit disposed on it. The regasification unit is adapted to operatively couple to an outlet of a liquefied natural gas carrier. The regasification unit is adapted to operatively couple at its outlet to a tap on an offshore gas pipeline. The mobile floating platform is adapted to moor to at least one liquefied natural gas carrier.

11 Claims, 5 Drawing Sheets

METHOD AND APPARATUS FOR OFFSHORE LNG REGASIFICATION

FIELD OF THE INVENTION

The present invention relates to liquefied natural gas regasification. More particularly, the invention relates to offshore LNG regasification.

BACKGROUND OF THE INVENTION

World natural gas consumption is rising faster than that of any other fossil fuel. About two-thirds of the increase in gas demand is in the industrial and power generation sectors, while the remaining one-third is in space heating of buildings and homes. Recent technological improvements in the design, efficiency, and operation of combined cycle gas turbines have tilted the economics of power generation in favor of natural gas. With the demand for electricity constantly increasing, the demand for natural gas can be expected to increase even further.

As is the case with oil, natural gas is unevenly distributed throughout the world. More than one-third of the world's gas reserves are in the territory of the Former Soviet Union. The second largest gas reserve is located in the Middle East. However, North America accounts for more than one-half of the world's gas consumption. The United States alone consumes about 2.4 tcf more natural gas per year than it produces. Germany and Japan also import large amounts of natural gas each year. Thus, natural gas frequently needs to be transported from its production locations to the consumption locations. However, the low density of natural gas makes it more expensive to transport than oil. A section of pipe in oil service can hold 15 times more energy than when used to transport high pressure gas. An alternative method of natural gas transportation is by ships. While natural gas can be piped in a gaseous state, it needs to be liquefied so that it may be economically transported by ships. When natural gas is supercooled to minus 162° C., it becomes liquid, and takes up only 1/600th as much space as gas. Liquefaction makes it practical to ship natural gas in large volumes, using specially designed ships that maintain the cargo's ultra-low temperature. Once liquefied natural gas (LNG) is transported to its destination, it is converted into gas at a regasification terminal before it is sent to the consuming end. Thus, regasification terminals are important links in the natural gas supply chain.

Most regasification units in operation are located at onshore terminals. FIG. 1 illustrates one such terminal. As shown in FIG. 1, an onshore LNG regasification terminal typically consists of a pier or jetty 1, storage tanks 2, and regasification plants 3. An LNG ship 5 comes and berths at the pier 1, and off-loads its cargo of LNG to storage tanks 2 which keep the gas in the same liquid state as they are transported. LNG in the storage tank 2 is later regasified at the regasification plant 3 to produce natural gas which is then transferred to end users through pipelines (not shown).

The storage tanks 2 typically are double barrier tanks with an "interior" container installed inside an independently reinforced concrete caisson. Built of concrete and steel, the inner tanks typically are made of 9% nickel steel and the secondary containers are typically made of pre-stressed concrete with a steel liner. The regasification plant 3 (or regasification unit) typically consists of heat exchangers (vaporizers) 3*a*, pumps 3*b*, and compressors 3*c*. Regasifying or regasification means bringing the cold LNG to the gaseous state at the ambient temperature and proper pressure so that it can be exported and fed into the existing pipeline grid for sale and transport to the consuming end.

To date, most LNG regasification facilities have been built onshore. However, public concern about safety has caused the gas industry to look for remote sites for such facilities. One alternative is to build the regasifi cation facility offshore. Various offshore terminals with different configurations and combinations have been proposed. Most of these offshore designs are based on large floating barges installed to mooring systems. As shown in FIG. 2, an offshore regasification terminal typically includes a barge 16 with storage tanks 11 and means (not shown) for a vessel to approach, berth and offload its cargo. The barge 16 includes at least one regasification unit 12 and a connector 13 that is adapted to connect to an underwater pipeline 15 via a riser 14. Offshore LNG regasification terminals offer potential advantages over their onshore counterparts because they are further removed from populated areas thus minimizing risk to neighboring areas and reducing ship traffic and minimizing ships traveling in restricted waterways.

In an offshore terminal, the storage tanks 11 are incorporated in a barge 16 that supports the tanks. The storage tanks 11 may be membrane or non-membrane (freestanding) tanks. The main difference between these two types of tanks is how they are insulated. Membrane tanks are typically made with an inner liner of, for example, stainless steel or a specialized alloy such as invar (35% nickel steel). Non-membrane (freestanding) tanks are either spherical or prismatic and are typically made of aluminum or 9% nickel steel. In membrane tanks, insulation is built outside the liner in a manner that allows circulation of an inert gas, usually liquid nitrogen, through the insulating material, in order to monitor the integrity of the barrier. In non-membrane tanks, whether spherical or prismatic, the insulation is built and applied to the outside surface of the tanks.

Both types of tanks, whether prismatic or spherical, and whether membrane insulated or not, have been proposed for use in offshore LNG regasification systems. However, prismatic tanks are preferable, because as in the ships they allow for a more rational use of the space available in the offshore barge. As is the case for onshore terminals, in order to export the gas into the pipeline system, the cold-stored LNG must be brought to ambient temperature and the corresponding pipeline pressure. This is accomplished at the regasification unit 12 fitted onboard the barge. The regasification unit 12 is usually built on top of the tanks 11, in case of prismatic tanks, or around and between them, in case of spherical tanks (not shown).

The flow of gas from the barge 16 to the onshore pipeline system (not shown) may be accomplished through a riser 14 connected to the sea bottom where an underwater pipeline 15 receiving end exists. The riser 14 connection at the barge end may be made through a fixed point in the case where the barge 16 is spread-moored, with mooring lines directly attached to several points on the barge 16. The riser 14 connection may also be through a turret system such as shown at 13, that provides a common end for the moored lines 17, and connects the riser 14 through a swivel (not shown), so that the barge 16 may weathervane due to change of direction of the environmental conditions while gas is flowing to the riser 14. Instead of the turret system 13, the barge 16 may also be moored to a CALM buoy (not shown), that also provides single point mooring, and thus weathervaning, with the mooring system attached to buoy itself and thus independent of the barge 16. The preferred solution is for the barge to 16 weathervane through a connector such as a turret or CALM buoy system. This scheme allows the ships carrying LNG to approach and moor alongside the barge 16 thus allowing side-byside offloading the LNG cargo from the ships; side-by-side offloading is more convenient. However, in order to conveniently and safely moor the LNG ships alongside the barge 16, the barge 16 has to be longer than any conventional LNG carrier.

U.S. Pat. No. 6,089,022, issued to Zednik et al., discloses a method to regasify LNG onboard an LNG tanker before transferring the gas to an onshore facility. This approach requires that each LNG tanker be equipped with a vaporizer. A specially designed FSRU (floating LNG storage and regasification unit) has also been designed based on a tanker type double-hulled vessel permanently moored in water by means of a turret single point mooring (SPM).

While these offshore regasification approaches offer some advantages over onshore facilities, it is desirable that an offshore regasification system permits regular LNG carriers to unload their cargoes and to regasify LNG before it is transported to an onshore facility.

SUMMARY OF THE INVENTION

One aspect of the invention is an offshore liquefied natural gas (LNG) regasification system, which includes a mobile floating platform having a regasification unit disposed on it. The regasification unit is adapted to operatively couple to an outlet of a liquefied natural gas carrier. The regasification unit is adapted to operatively couple at its outlet to a tap on an offshore gas pipeline. The mobile floating platform is adapted to moor at least one liquefied natural gas carrier. In one embodiment, the platform is a modified very large crude carrier (VLCC). In one embodiment, the VLCC includes a propulsion unit, so that the VLCC may sail to a location for regasifying LNG according to market demand. In one embodiment, the floating platform includes a system for maintaining freeboard substantially the same as the freeboard of an LNG carrier berthed to the floating platform as the LNG is offloaded and regasified.

Another aspect of the invention relates to methods for regasifying LNG at a selected location. One embodiment of the invention comprises determining the selected location based on market demand for natural gas; moving an offshore regasification system to the selected location, berthing an LNG carrier next to the regasification system, and offloading and regasifying the liquefied natural gas.

Other aspects of the invention will become apparent form the following discussion.

DETAILED DESCRIPTION

Generally, a regasification system according to various embodiments of the invention includes a vaporizer, (or liquefied natural gas regasification unit) disposed on a mobile, floating platform. The regasification unit is adapted to operatively couple at its inlet to an offloading line of a liquefied natural gas (LNG) carrier. The regasification unit is operatively coupled at its outlet to a natural gas pipeline.

Some embodiments of the regasification system according to invention make use of a modified very large crude carrier (VLCC) as the mobile, floating platform for offshore regasification of LNG. These embodiments use the VLCC to hold the regasification unit, which typically includes vaporizers, pumps and compressors. While the various embodiments of a system according to the invention are based on a modified VLCC as the mobile, floating platform, it should be understood that other forms of mobile, floating platforms may be used in other embodiments of the invention, for example, a barge or the like, or a buoy.

In one embodiment, the regasification unit is connected at its output to an offshore pipeline through a sub-sea riser and connector such as a turret. An LNG carrier moors alongside the modified VLCC and offloads its cargo of liquefied natural gas directly to the input of the regasification unit disposed on the modified VLCC. In some embodiments, safe berthing of the LNG carrier is provided by the size of the modified VLCC. In some embodiments, continuous operation of the regasification system is provided by berthing a second LNG carrier on the other side of the modified VLCC, so that when one of the LNG carriers becomes empty, LNG flow may begin from the other LNG carrier, until the empty LNG carrier is replaced by a fully loaded one.

Figure 1:
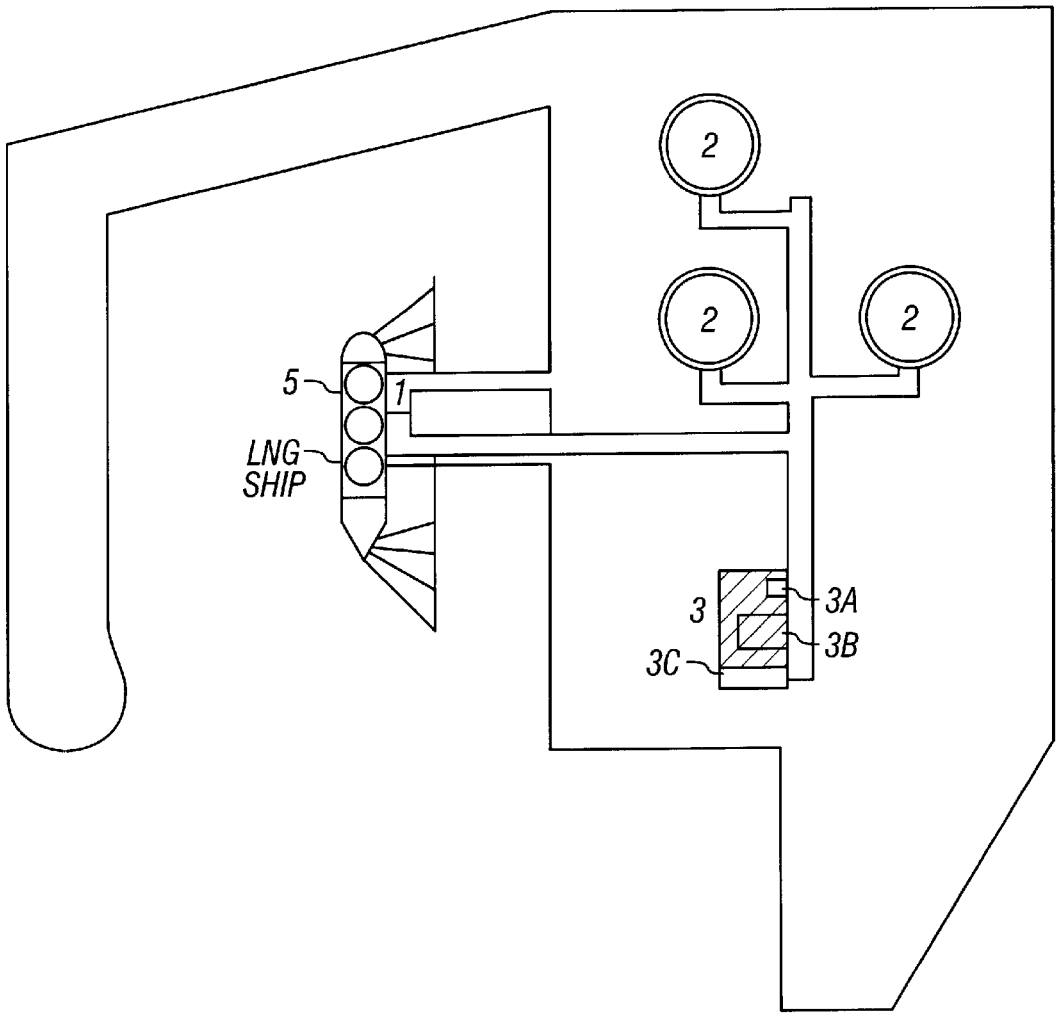
FIG. 1 (Prior Art)
FIG. 1 is a schematic diagram of an onshore LNG regasification te,.inal.
Figure 2:
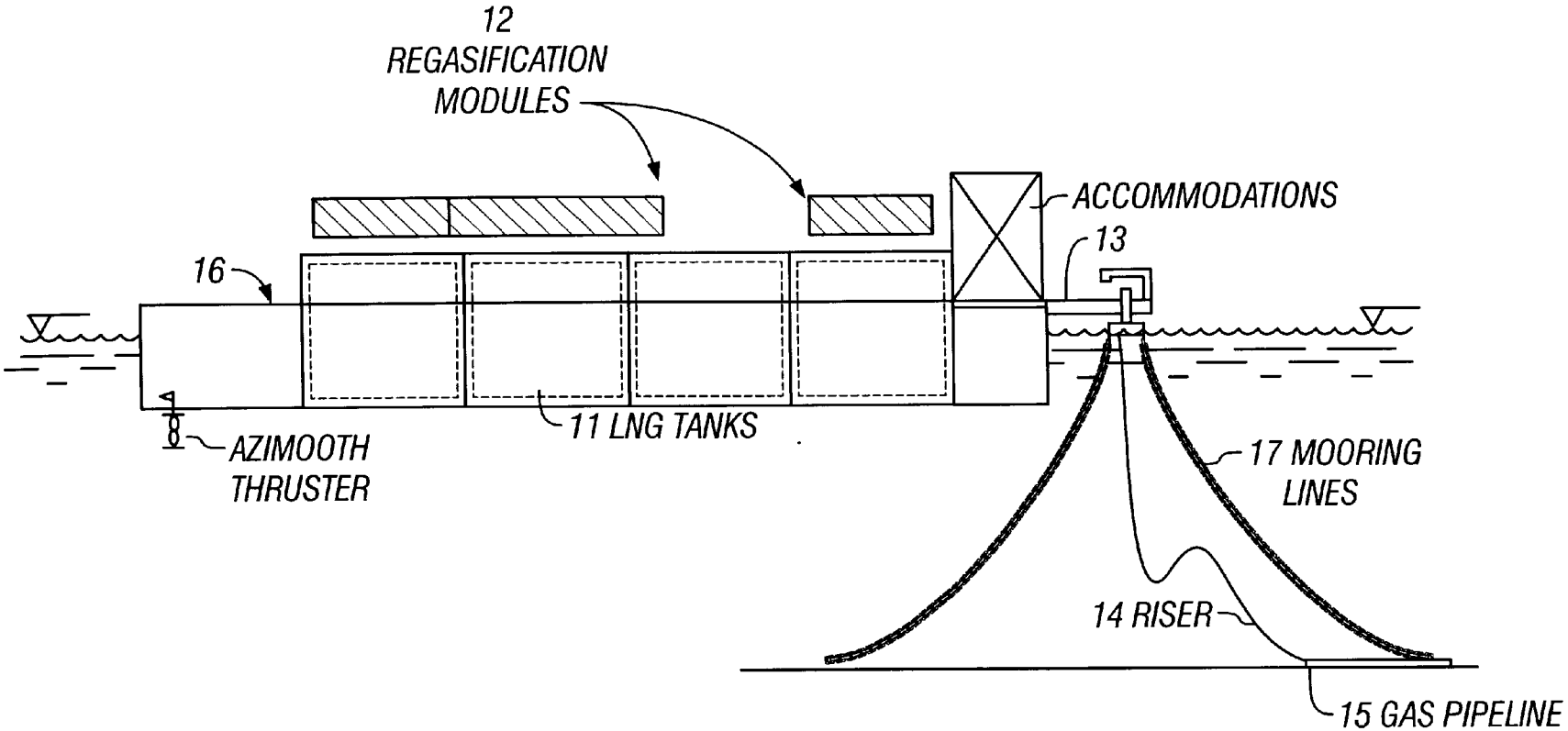
FIG. 2 (Prior Art)
FIG. 2 is a schematic diagram of a prior art offshore LNG regasification terminal based on a barge.
Figure 3:
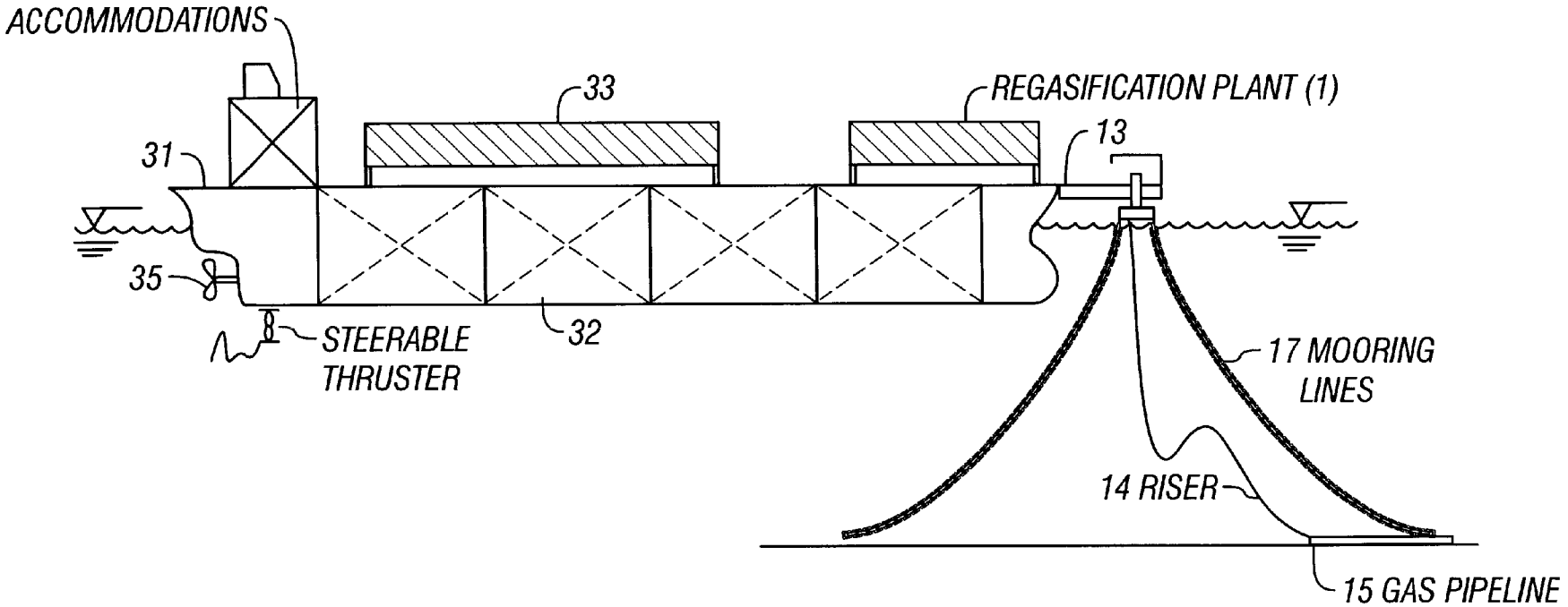
FIG. 3 is a schematic diagram of one embodiment of an offshore regasification system according to the invention including a regasification unit disposed on a modified VLCC.

In one embodiment, as illustrated in FIG. 3, a modified VLCC 31 is fitted with a regasification unit 33 on its deck. The modified VLCC 31, if made from an existing ship, after unnecessary piping and other auxiliary equipment are cleared away, will generally have more than adequate deck space to fit a high capacity, regasification unit. In addition, main boilers (not shown) which may have been originally provided on the VLCC 31 (when made by retrofit of an existing ship) may be converted into gas-burning units to provide power for propulsion of the modified VLCC 31. The main propulsion unit 35 of the modified VLCC 31 (if made from an existing ship) may be retained in some embodiments so that the modified VLCC 31 may sail under its own power to any place as required by gas market demands, as will be further explained. The mobility of the modified VLCC 31 also makes it possible for modified VLCC 31 to avoid bad weather by uncoupling from the turret 13 and riser connection 14 and moving out of the area of bad weather. The regasification unit 33 is adapted to coupled directly to the cargo output of an LNG carrier (not shown in FIG. 3). In the invention, LNG is moved directly from the carrier (not shown in FIG. 3) to the regasification unit 33, where it is regasified and transferred to a pipeline. The invention thus avoids the need to provide storage for LNG on the floating platform which houses the regasification unit 33, as is typical for prior art offshore regasification systems.

The turret 13 may be substituted by a buoy (not shown) to bring the riser connection 14 to the ocean surface and provides a single point for the mooring lines. The buoy (not shown) is fixed in position by mooring lines 17. The lower end of the riser connection 14 is coupled to tap on a gas pipeline 15. In this case, the mobile floating platform (such as modified VLCC 31) is moored to the buoy (not shown). In all cases, the only additional requirement to operate an offshore regasification system such as shown in FIG. 3 is that the mooring system and riser be available at the selected locations.

Figure 4:
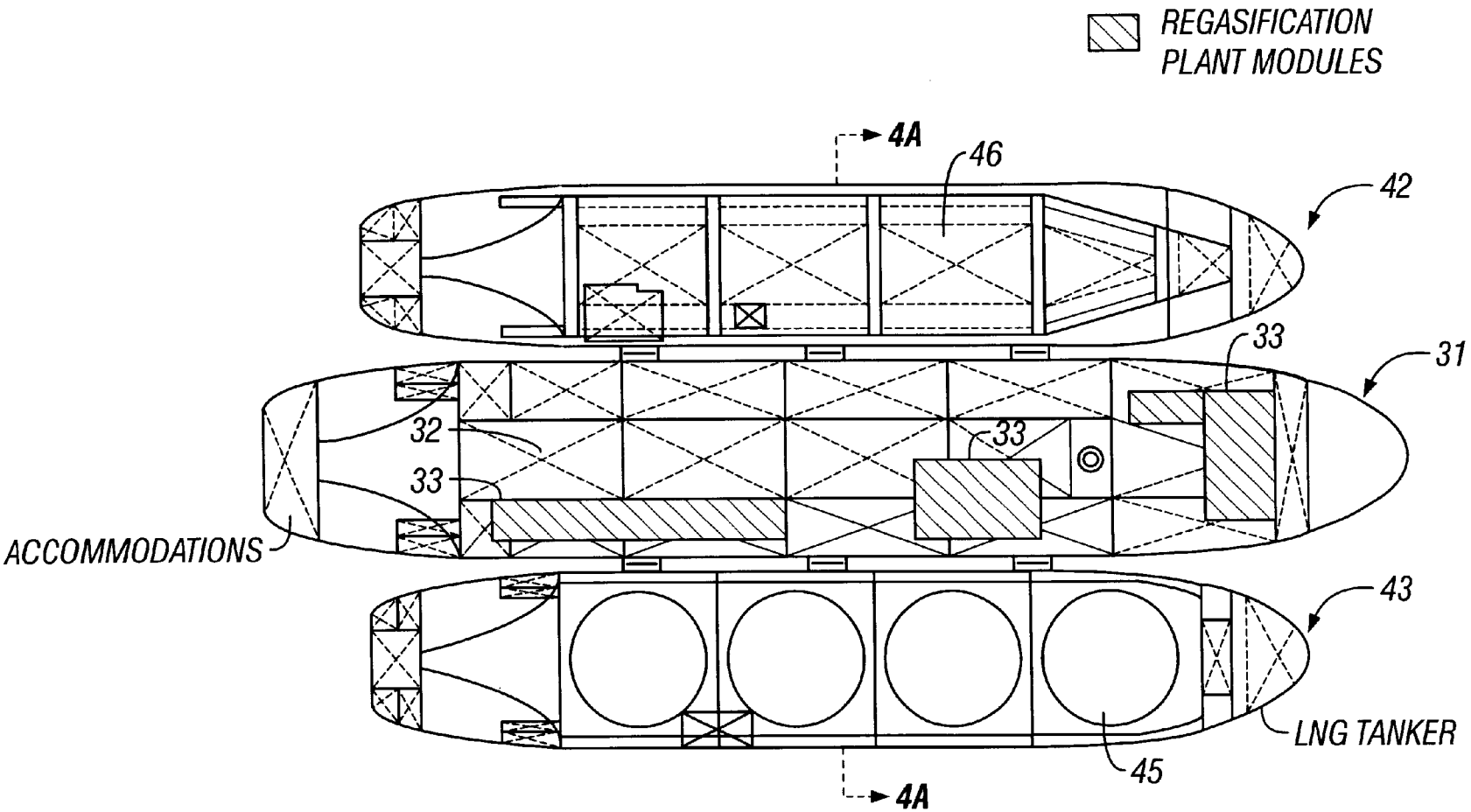
FIG. 4 is a top view of one embodiment of an offshore regasification system according to the invention including LNG carriers berth along either side of a modified VLCC.

FIG. 4 shows a top view of the embodiment of the invention of FIG. 3 (i.e., a VLCC 31 retrofitted with regasification units 33), as it is used with two LNG carriers 42 and 43 berthed on either side of the modified VLCC 31. The LNG carriers 42 and 43 shown in FIG. 4 may have either membrane tanks 45 or freestanding tanks 46, respectively, for transport of liquefied natural gas (LNG) therein.

Figure 4A:
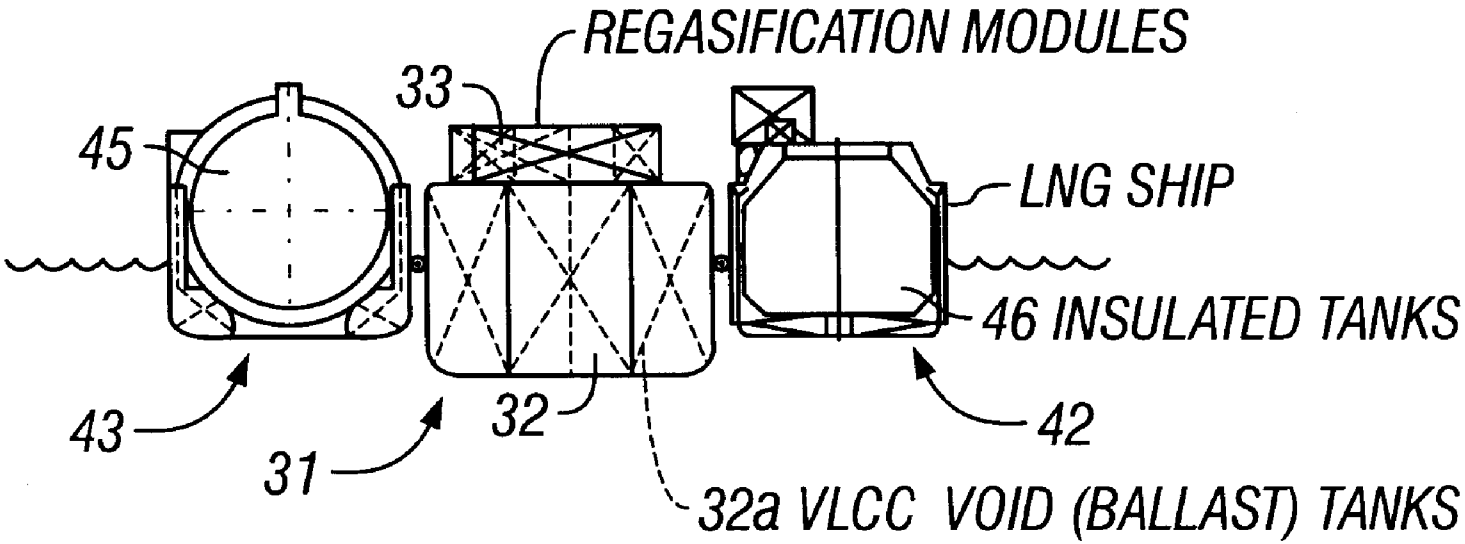
FIG. 4A is a cross section view of the embodiment shown in FIG. 4.

The example of FIG. 4 is shown in cross section in FIG. 4A. The freeboard of a typical LNG carrier (e.g., 42 and 43 in FIG. 4A) varies between about 12 m when fully loaded, to about 14 m in ballast condition. The freeboard of the modified VLCC 31 is typically in the range of about 6 m to 16 m. During unloading of LNG, the freeboards of the LNG carriers 42 and 43 and the modified VLCC 31 preferably should be kept substantially equal, as shown in FIG. 4A. This is preferable because loading arms (not shown), which typically will be installed on the modified VLCC 31 to transfer the LNG from the LNG carriers 42 and 43 to the modified VLCC 31, have relatively limited flexibility. To maintain a substantially equal freeboard during LNG unloading, the modified VLCC 31 should be ballasted accordingly. Typically the modified VLCC 31 should be ballasted instead of the LNG carriers 42 and 43 because most LNG carriers are not equipped to adjust their freeboards. Ballasting of the modified VLCC 31 can be performed by pumping sea water into or out of selected ones of the originally provided tanks 32*a* (when converted from an existing ship) on the modified VLCC 31. If the modified VLCC 31 is purpose-built, the selected tanks 32*a* may be purpose built as well. Other embodiments of the invention which use different types of mobile, floating platform may also include ballasting devices to maintain the freeboard of the floating, mobile platform substantially the same as that of the LNG carrier during offloading operations.

Another issue which should be addressed in various embodiments of the invention is that standard LNG carriers 42 and 43 have lower aft poop-decks where their mooring winches (not shown) are located. Therefore, the aft area of modified VLCC 31 (if made from an existing ship) should be altered so that it can provide a more convenient mooring for the LNG tankers 42 and 43.

In a method according to another aspect of the invention, the floating, mobile platform, for example, modified VLCC 31, may be moved to a selected geographic location having a riser connection (14 in FIG. 3) coupled to a gas pipeline (15 in FIG. 3) wherein it is determined that additional demand for natural gas may take place within a selected period of time. As the regasification unit 33 on the modified VLCC 31 is operatively coupled to the pipeline 15, LNG carriers, such as 42 and 43 may sail to the location of the modified VLCC 31, berth along side it, and offload their cargo of LNG for regasification and delivery to the pipeline 15. As natural gas market conditions change, the modified VLCC 31 may be moved to another geographic location having a riser connection to a pipeline, such as shown in FIG. 3, for example. In one example of a method according to this aspect of the invention, the modified VLCC 31 may sail under its own power to the other geographic locations as required by market conditions. In other embodiments, the modified VLCC 31 may not include the propulsion unit (35 in FIG. 3), and may be moved to the other geographic location using a tow vessel (not shown). In still other embodiments, the floating regasification system may be towed to the other geographic location. Embodiments of a method according to the invention may provide an economic benefit by reducing the number of floating regasification systems needed in a natural gas supply system, where the floating regasification systems are moved to and therefore provided only to geographic locations where gas demand requires their presence.

Embodiments of the present invention may provide significant economic benefits by modifying existing VLCCs to perform as offshore LNG regasification terminals, without the need to provide additional storage of LNG at the location of the regasification system. Embodiments of the invention also may provide economic advantages over prior art systems which include a regasification unit on individual LNG carriers, by reducing the number of such regasification units needed in a natural gas transportation and delivery system.

While the invention has been described using a limited number of embodiments, those skilled in the art, having the benefit of this disclosure, will appreciate that other variations are possible without departing from the scope of the invention as disclosed herein. Accordingly, the scope of the invention should be limited only by the attached claims.

What is claimed is:

1. An offshore liquefied natural gas regasification system, comprising:

a mobile floating platform having a regasification unit thereon; the regasification unit adapted to operatively couple at its inlet to an outlet of a liquefied natural gas carrier, the regasification unit adapted to operatively couple at its outlet to offshore gas pipeline; and the mobile floating platform adapted to moor at least one liquefied natural gas carrier.

2. The offshore regasification system as defined in claim 1 wherein the mobile floating platform comprises a modified very large crude carrier.

3. The offshore regasification system as defined in claim 2 wherein the modified very large crude carrier comprises a propulsion unit.

4. The offshore regasification system of claim 2, wherein the modified very large crude carrier further comprises a docking facility to allow docking of the at least one liquefied natural gas tanker thereto.

5. The offshore regasification system of claim 1 further comprising means for maintaining a freeboard of the modified very large crude carrier substantially equal to a freeboard of a liquefied natural gas carrier berthed thereto when liquefied natural gas is offloaded from the carrier.

6. A method for transporting liquefied natural gas to a pipeline at an offshore location, comprising:

transferring the liquefied natural gas from a liquefied natural gas carrier to an offshore regasification system disposed on a mobile, floating platform;

regasifying the liquefied natural gas using a regasification unit on the offshore regasification system; and transferring the regasified liquefied natural gas to the pipeline.

7. The method as defined in claim 6 wherein the mobile, floating platform comprises a modified very large crude carrier.

8. The method of claim 6 further comprising maintaining a freeboard of the mobile, floating platform substantially equal to a freeboard of the liquefied natural gas carrier as the liquefied natural gas is removed therefrom.

9. The method as defined in claim 6 further comprising moving the offshore regasification system to a selected geographic location based on market demand for natural gas, and repeating the transferring the liquefied natural gas, regasifying and transferring to the pipeline in response to the market demand.

10. A method for regasifying liquefied natural gas at a selected location, comprising:

determining the selected location based on a market demand for natural gas;

moving a mobile offshore regasification system to the selected location;

transferring liquefied natural gas from a liquefied natural gas tanker to the offshore regasification system;

regasifying the liquefied natural gas; and transferring the regasified liquefied natural gas to a pipeline.

11. The method as defined in claim 10 further comprising:

determining an additional selected location based on market demand; moving the mobile offshore regasification system to the additional selected location; and repeating the transferring the liquefied natural gas, regasifying and the transferring the regasified liquefied natural gas in response to the market demand at the additional selected location.

* * * * *

UNITED STATES PATENT AND TRADEMARK OFFICE

CERTIFICATE OF CORRECTION

PATENT NO. : 6,546,739 B2
DATED : April 15, 2003
INVENTOR(S) : Fernando C. Frimm et al.

It is certified that error appears in the above-identified patent and that said Letters Patent is hereby corrected as shown below:

Column 2,
Line 6, replace “regasifi cation” with -- regasification --

Column 3,
Line 47, replace “form” with -- from --
Line 52, replace “te,.inal” with -- terminal --

Signed and Sealed this

Eighth Day of July, 2003

JAMES E. ROGAN
*Director of the United States Patent and Trademark Office*